US008653726B2

(12) United States Patent
Kataoka

(10) Patent No.: US 8,653,726 B2
(45) Date of Patent: Feb. 18, 2014

(54) SPARK PLUG

(75) Inventor: Yoshikazu Kataoka, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/805,696

(22) PCT Filed: Mar. 3, 2011

(86) PCT No.: PCT/JP2011/001260
§ 371 (c)(1),
(2), (4) Date: Dec. 20, 2012

(87) PCT Pub. No.: WO2012/001841
PCT Pub. Date: Jan. 5, 2012

(65) Prior Publication Data

US 2013/0099655 A1 Apr. 25, 2013

(30) Foreign Application Priority Data

Jun. 28, 2010 (JP) ..... 2010-145878

(51) Int. Cl.
*H01T 13/32* (2006.01)

(52) U.S. Cl.
USPC ..... 313/141; 313/142

(58) Field of Classification Search
USPC ..... 313/141, 142
See application file for complete search history.

(56) References Cited

U.S. PATENT DOCUMENTS

| | | | | |
|---|---|---|---|---|
| 8,013,504 | B2 | 9/2011 | Kameda et al. | 313/141 |
| 8,120,235 | B2 | 2/2012 | Nunome et al. | 313/141 |
| 8,188,641 | B2 | 5/2012 | Kameda et al. | 313/142 |
| 2003/0071552 | A1 | 4/2003 | Teramura et al. | 313/143 |
| 2009/0127997 | A1 | 5/2009 | Kameda et al. | 313/141 |
| 2009/0134764 | A1 | 5/2009 | Kameda et al. | 313/141 |
| 2010/0264803 | A1 | 10/2010 | Nunome et al. | 313/141 |
| 2010/0264804 | A1 | 10/2010 | Kameda et al. | 313/141 |
| 2010/0275870 | A1 | 11/2010 | Kameda et al. | 123/169 |
| 2010/0283373 | A1 | 11/2010 | Kameda | 313/141 |

FOREIGN PATENT DOCUMENTS

| | | | |
|---|---|---|---|
| JP | 2001-307858 | 11/2001 | H01T 13/20 |
| JP | 2009-129908 | 6/2009 | H01T 13/32 |
| WO | WO 2009/066714 | 5/2009 | H01T 13/32 |
| WO | WO2009/084575 | 9/2009 | H01T 13/32 |

OTHER PUBLICATIONS

International Search Report for International Application No. PCT/JP2011/001260, May 17, 2011.

Notification of Reason for Rejection (dated Feb. 26, 2013) issued in connection with corresponding Japanese Patent Application No. 2011-525342, with English translation.

*Primary Examiner* — Vip Patel
(74) *Attorney, Agent, or Firm* — Kusner & Jaffe

(57) ABSTRACT

A spark plug includes a ground electrode. The cross sectional area S of a ground electrode base member of the ground electrode satisfies a relation 1.8 $mm^2 \leq S \leq 3.2$ $mm^2$. The embedment depth A of a noble metal tip embedded in a second base member surface and the tip thickness B of the noble metal tip measured along the direction in which the noble metal tip is embedded in the second base member surface satisfy a relation $0.4 \leq (A/B) \leq 0.8$.

6 Claims, 10 Drawing Sheets

SPARK PLUG

FIELD OF THE INVENTION

The present invention relates to a spark plug (ignition plug) which ignites a fuel through electrical generation of spark in an internal combustion engine.

BACKGROUND OF THE INVENTION

Conventionally, there has been proposed a spark plug in which, in order to improve ignition performance and durability of its ground electrode, a noble metal tip is embedded into the ground electrode by means of resistance welding such that the noble metal tip projects from the distal end of the base member of the ground electrode (see, for example, Japanese Patent Application Laid-Open (kokai) No. 2009-129908, "Patent Document 1"). In the case of the ground electrode in which a noble metal tip is embedded into the ground electrode base member, due to heat generated in an internal combustion engine, oxide scale is formed at a joint portion between the ground electrode base member and the noble metal tip in some cases. Excessive formation of such oxide scale may result in separation of the noble metal tip from the ground electrode base member.

SUMMARY OF THE INVENTION

Problems to be Solved by the Invention

Conventionally, sufficient studies have not been conducted on the influence, on formation of oxide scale, of the amount by which the noble metal tip is embedded into a ground electrode base member.

In view of the above-described problem, an object of the present invention is to provide a technique which can improve the durability of a spark plug.

Means for Solving the Problems

To solve, at least partially, the above problems, the present invention can be embodied in the following modes or application examples.

Application example 1: A spark plug comprising a rod-like center electrode extending along an axis, an insulator provided around the center electrode, a metallic shell provided around the insulator, and a ground electrode which is joined to the metallic shell and which forms a gap in cooperation with the center electrode. The ground electrode includes a ground electrode base member and a rectangular parallelepiped-shaped noble metal tip. The ground electrode base member extends from the metallic shell toward the center electrode, and has a first base member surface which is an end surface on the side toward the center electrode and a second base member surface adjacent to the first base member surface. The noble metal tip is embedded in the ground electrode base member, through resistance welding, such that the noble metal tip projects from the first base member surface and the second base member surface, and has a facing surface which faces the center electrode. The spark plug is characterized in that a cross section of the ground electrode base member orthogonal to a center axis of the ground electrode base member has a cross-sectional area S which satisfies a relation 1.8 $mm^2 \leq S \leq 3.2\ mm^2$, and an embedment depth A and a tip thickness B satisfy a relation $0.4 \leq (A/B) \leq 0.8$, where the embedment depth A is a depth by which the noble metal tip is embedded in the second base member surface, and the tip thickness B is a thickness of the noble metal tip as measured along a direction in which the noble metal tip is embedded in the second base member surface. According to the spark plug of the application example 1, while suppressing generation of dendrite in the ground electrode base material at the time when the noble metal tip is embedded into the ground electrode base member, formation of oxide scale at the joint portion between the ground electrode base member and the noble metal tip can be suppressed. As a result, the durability of the spark plug can be enhanced.

Application example 2: The spark plug described in application example 1, wherein a relation $0.6 \leq (A/B) \leq 0.8$ is satisfied. According to the spark plug of the application example 2, formation of oxide scale at the joint portion between the ground electrode base member and the noble metal tip can be suppressed further.

Application example 3: The spark plug described in application example 1 or 2, wherein an embedment depth C and a tip length D satisfy a relation $0.6 \leq (C/D) < 1.0$, where the embedment depth C is a depth by which the noble metal tip is embedded in the first base member surface, and the tip length D is a length of the noble metal tip as measured along the direction in which the noble metal tip is embedded in the first base member surface. According to the spark plug of the application example 3, the joint strength between the ground electrode base member and the noble metal tip can be increased.

Application example 4: The spark plug described in any one of application examples 1 to 3, wherein the second base member surface is a flat surface orthogonal to the axis, and a tip width E and a flat surface width F satisfy a relation $(E/F) \leq 0.5$, where the tip width E is a width of the noble metal tip as measured along a direction which is orthogonal to the axis and is parallel to the first base member surface, and the flat surface width F is a width of the second base member surface as measured along a direction parallel to the first base member surface. According to the spark plug of the application example 4, formation of a bulge which bulges from the ground electrode base member at the time when the noble metal tip is joined to the ground electrode base member through resistance welding can be suppressed. As a result, deterioration of the ground electrode base member due to formation of a bulge can be prevented.

Application example 5: The spark plug described in any one of application examples 1 to 4, wherein the facing surface faces an end surface or a side surface of the center electrode. According to the spark plug of application example 5, spark can be generated between the end surface or the side surface of the center electrode and the noble metal tip of the ground electrode.

Application example 6: The spark plug described in any one of application examples 1 to 5, wherein the tip length D, which is the length of the noble metal tip as measured along the direction in which the noble metal tip is embedded in the first base member surface, satisfies a relation $1.1\ mm \leq D \leq 1.3\ mm$. According to the spark plug of the application example 6, the durability of the spark plug can be improved without impairing the ignition performance.

The present invention is not limited to a mode in which the present embodiment is implemented in the form of a spark plug. For example, the present invention can be applied to various other modes in which the present invention is implemented in the form of a ground electrode of a spark plug, an internal combustion engine including a spark plug, or a method for manufacturing a spark plug, or the like. Also, the present invention is not limited to the above-described modes, and can be practiced in various modes without departing from the scope of the invention.

DETAILED DESCRIPTION OF THE INVENTION

A spark plug to which the present invention is applied will now be described for further understanding of the above-described configuration and action of the present invention.

Figure 1:
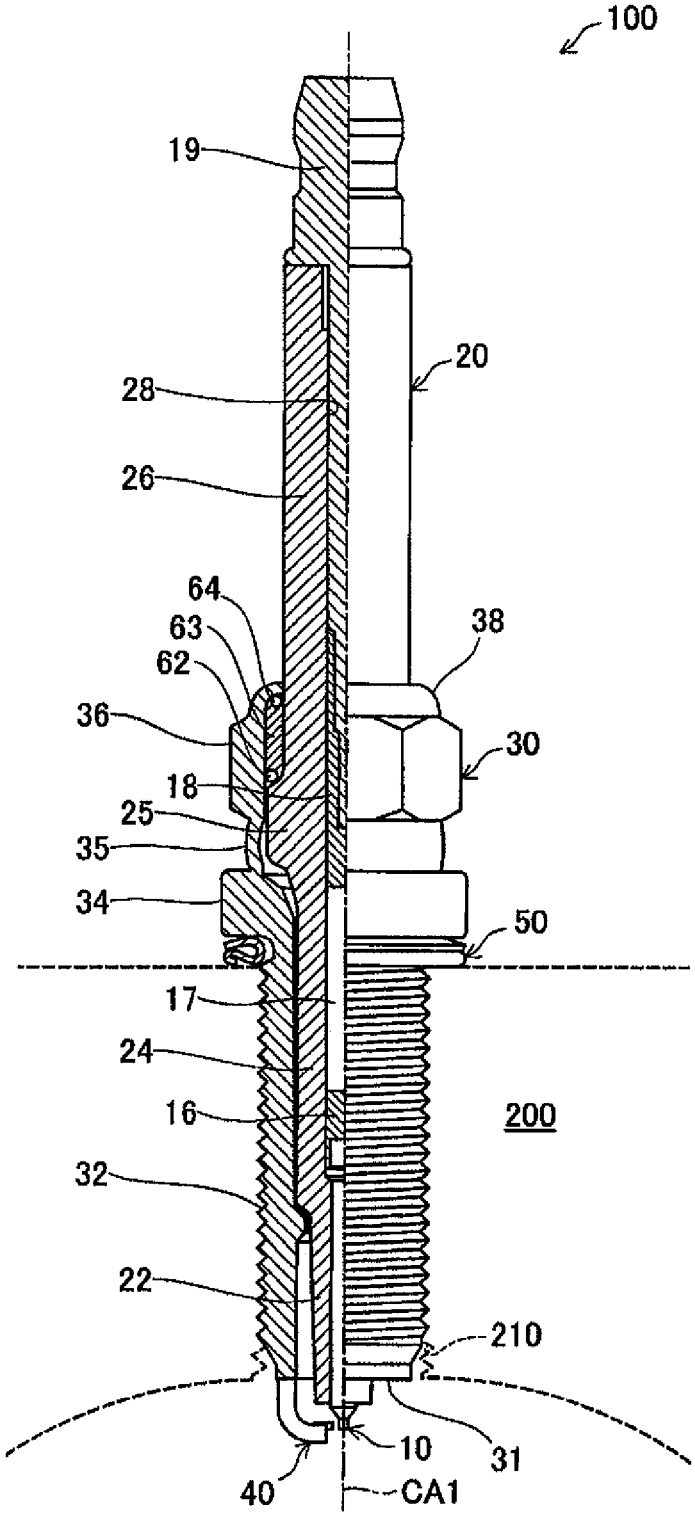
FIG. 1 is a partial cross-sectional view showing a spark plug.

A. Embodiment:

A-1: Structure of Spark Plug:

FIG. 1 is a partial cross-sectional view showing a spark plug 100. In FIG. 1, the external shape of the spark plug 100 is illustrated on one side of a center axis CA1, which is the axis of the spark plug 100, and the cross-sectional shape of the spark plug 100 is illustrated on the other side thereof. The spark plug 100 includes a center electrode 10, an insulator 20, a metallic shell 30, and a ground electrode 40. In the present embodiment, the center axis CA1 of the spark plug 100 also serves as respective axes of the center electrode 10, insulator 20, and the metallic shell 30.

In the spark plug 100, the circumference of the rod-like center electrode 10 extending along the center axis CA1 is electrically insulated by the insulator 20. One end of the center electrode 10 projects from one end of the insulator 20, and the other end of the center electrode 10 is electrically connected to a terminal metal piece 19 at the other end of the insulator 20. A metallic shell 30 is fixed to the periphery of the insulator 20 through crimping such that it is electrically insulated from the center electrode 10. The ground electrode 40 is electrically connected to the metallic shell 30, and a spark gap, which is a clearance for generating spark, is formed between the center electrode 10 and the ground electrode 40. The metallic shell 30 is screwed into a mount screw hole 210 formed in the engine head 200 of an internal combustion engine (not shown), whereby the spark plug 100 is attached to the engine. When a high voltage of 20,000 V to 30,000 V is applied to the center electrode 10, spark is generated at the spark gap formed between the center electrode 10 and the ground electrode 40.

The center electrode 10 of the spark plug 100 is a rod-like electrode composed of an electrode base member formed into a bottomed tubular shape, and a core which is embedded in the electrode base member and is higher in heat conductivity than the electrode base member. In the present embodiment, the electrode base member of the center electrode 10 is formed of a nickel alloy whose main component is nickel, such as Inconel (registered trademark), and the core of the center electrode 10 is formed of copper or an alloy whose main component is copper. In the present embodiment, a noble metal tip whose main component is iridium is welded to the distal end of the electrode base member of the center electrode 10. In the present embodiment, the center electrode 10 is fixed to the insulator 20 such that the distal end of the electrode base member projects from one end of the insulator 20, and is electrically connected to the terminal metal piece 19 at the other end of the insulator 20 via a seal member 16, a ceramic resistor 17, and a seal member 18.

The insulator 20 of the spark plug 100 is a part formed by firing an insulative ceramic material such as alumina. The insulator 20 is a tubular body having an axial hole 28 for receiving the center electrode 10, and includes a leg portion 22, a first insulator trunk portion 24, an insulator flange portion 25, and a second insulator trunk portion 26 formed along the center axis CA1 in this sequence from the side from which the center electrode 10 projects. The leg portion 22 of the insulator 20 is a tubular portion whose outer diameter decreases toward the side from which the center electrode 10 projects. The first insulator trunk portion 24 of the insulator 20 is a tubular portion having an outer diameter greater than that of the leg portion 22. The insulator flange portion 25 of the insulator 20 is a tubular portion having an outer diameter greater than that of the first insulator trunk portion 24. The second insulator trunk portion 26 of the insulator 20 is a tubular portion having an outer diameter smaller than that of the insulator flange portion 25, and secures a sufficient insulation distance between the metallic shell 30 and the terminal metal piece 19.

In the present embodiment, the metallic shell 30 of the spark plug 100 is a member formed of low carbon steel and plated with nickel. However, in a different embodiment, the metallic shell 30 may be a member formed of low carbon steel and plated with zinc, or an unplated member formed of a nickel alloy. In the present embodiment, the metallic shell 30 is fixed to the insulator 20 through cold crimping. However, in a different embodiment, the metallic shell 30 may be fixed to the insulator 20 through hot crimping. The metallic shell 30 includes an end surface 31, a mount screw portion 32, a trunk portion 34, a groove portion 35, a tool engagement portion 36, and a crimp portion 38 formed along the center axis CA1 in this sequence from the side from which the center electrode 10 projects.

The end surface 31 of the metallic shell 30 is an annular surface formed at the distal end of the mount screw portion 32. The ground electrode 40 is joined to the end surface 31, and the center electrode 10, which is surrounded by the leg portion 22 of the insulator 20, projects through a center opening surrounded by the end surface 31. The mount screw portion 32 of the metallic shell 30 is a cylindrical tubular portion having, on its outer circumference, a screw thread which is screwed into the mount screw hole 210 of the engine head 200. The trunk portion 34 of the metallic shell 30 is a flange-shaped portion which is provided adjacent to the groove portion 35 and projects radially outward in relation to the groove portion 35. The trunk portion 34 compresses a gasket 50 toward the engine head 200. The groove portion 35 of the metallic shell 30 is a portion which is provided between the trunk portion 34 and the tool engagement portion 36 and bulges radially outward when the metallic shell 30 is fixed to the insulator 20 through crimping. The tool engagement portion 36 of the metallic shell 30 is a flange-shaped portion which is provided adjacent to the groove portion 35 and bulges radially outward in relation to the groove portion 35. The tool engagement portion 36 is formed into a shape corresponding to the shape of a tool (not shown) used to mount the spark plug 100 to the engine head 200. The crimp portion 38 of the metallic shell 30 is a portion which is provided adjacent to the tool engagement portion 36. The crimp portion 38 is deformed for close contact with the second insulator trunk portion 26 of the insulator 20 when the metallic shell 30 is fixed to the insulator 20 through crimping. Powder of talc is charged into a region between the crimp portion 38 of the metallic shell 30 and the insulator flange portion 25 of the insulator 20, whereby a talc charged portion 63 is formed, and is sealed by packings 62 and 64.

Figure 2:
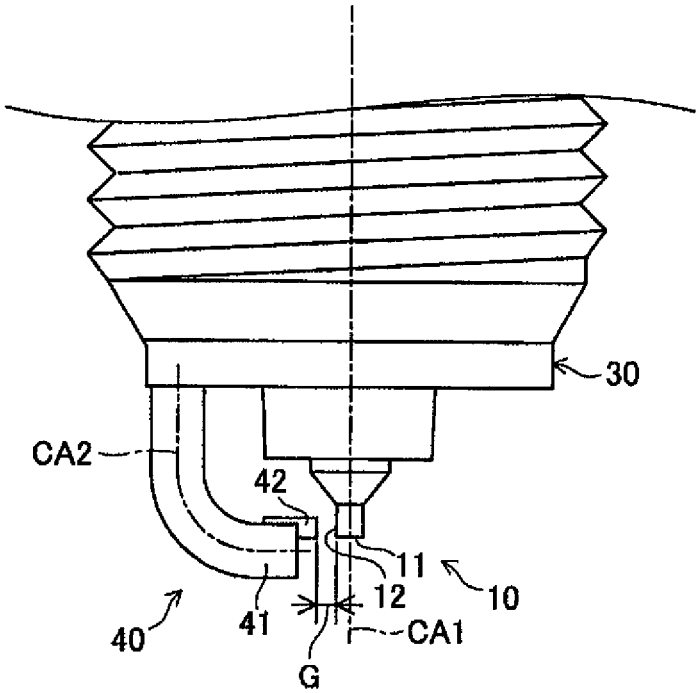
FIG. 2 is an explanatory view showing, on an enlarged scale, the center electrode and ground electrode of the spark plug.

FIG. 2 is an explanatory view showing, on an enlarged scale, the center electrode 10 and the ground electrode 40 of the spark plug 100. The ground electrode 40 of the spark plug 100 is welded to the metallic shell 30, and a spark gap G is formed between the ground electrode 40 and the center electrode 10. In the present embodiment, at the end of the rod-like center electrode 10 are formed an end surface 11 orthogonal to the center axis CA1 and a side surface 12 extending along the center axis CA1. The spark gap G is formed between the ground electrode 40 and the side surface 12 of the center electrode 10.

The ground electrode 40 includes a ground electrode base member 41 and a noble metal tip 42. The ground electrode base member 41 of the ground electrode 40 is an electrode which extends from the metallic shell 30 toward the center electrode 10. The center axis CA2 of the ground electrode base member 41 extends from the metallic shell 30 along the center axis CA1, and then bends toward the center electrode 10; i.e., extends along a direction intersecting the center axis CA1. In the present embodiment, the outer layer of the ground electrode base member 41 is formed of a nickel alloy whose main component is nickel, such as Inconel (registered trademark), and the inner layer of the ground electrode base member 41 is formed of copper or a copper alloy whose heat conductivity is higher than that of the outer layer. The noble metal tip 42 of the ground electrode 40 is a rectangular parallelepiped-shaped member formed of a material containing a noble metal. The noble metal tip 42 is embedded in the ground electrode base member 41 by means of resistance welding such that the noble metal tip 42 projects toward the side surface 12 of the center electrode 10. In the present embodiment, the noble metal tip 42 is formed of a noble metal alloy which contains platinum (main component) and rhodium (20% by mass).

Figure 3:
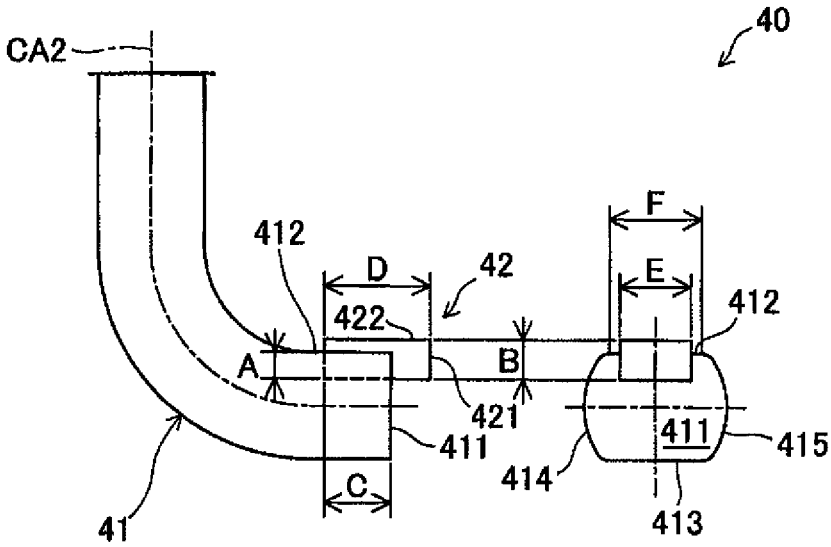
FIG. 3 is an explanatory view showing, in detail, the structure of the ground electrode.

FIG. 3 is an explanatory view showing the structure of the ground electrode 40 in detail. FIG. 3 illustrates a side view of the ground electrode 40 as viewed from a side from which the bent shape of the ground electrode base member 41 can be viewed and a front view of the ground terminal 40 as viewed from the center electrode 10 side. The ground electrode base member 41 of the ground electrode 40 includes a first base member surface 411, a second base member surface 412, a third base member surface 413, a fourth base member surface 414, and a fifth base member surface 415. The first base member surface 411 of the ground electrode base member 41 is an end surface located on the center electrode 10 side. In the present embodiment, the first base member surface 411 is a flat surface extending along the center axis CA1 of the center electrode 10. The second base member surface 412 of the ground electrode base member 41 is a portion of a side surface among the side surfaces adjacent to the first base member surface 411. The second base member surface 412 is located on the inner side of the bent shape. In the present embodiment, the second base member surface 412 is a flat surface orthogonal to the center axis CA1 of the center electrode 10. The third base member surface 413 of the ground electrode base member 41 is a portion of a side surface among the side surfaces adjacent to the first base member surface 411. The third base member surface 413 is located on the outer side of the bent shape. The fourth base member surface 414 and the fifth base member surface 415 of the ground electrode base member 41 are side surfaces among the side surfaces adjacent to the first base member surface 411, which extend between the second base member surface 412 and the third base member surface 413. In the present embodiment, the cross-sectional shape of the ground electrode base member 41 orthogonal to the center axis CA2 is an approximate rectangle. Among the four sides thereof, the two opposite sides corresponding to the second base member surface 412 and the third base member surface 413 are parallel to each other, and the remaining two opposite sides corresponding to the fourth base member surface 414 and the fifth base member surface 415 have an outward curvature.

The noble metal tip 42 of the ground electrode 40 is joined to the ground electrode base member 41 through resistance welding such that the noble metal tip 42 is embedded in the ground electrode base member 41 and projects from the first base member surface 411 and the second base member surface 412 of the ground electrode base member 41. The noble metal tip 42 has a first tip surface 421 and a second tip surface 422. The first tip surface 421 of the noble metal tip 42 is one of the two flat surfaces of the rectangular parallelepiped-shaped noble metal tip 42, which are not embedded in the ground electrode base member 41, among the six surfaces thereof. In the present embodiment, the first tip surface 421 is a flat surface parallel to the first base member surface 411 of the ground electrode base member 41; namely, a flat surface extending along the center axis CA1 of the center electrode 10. In the present embodiment, the first tip surface 421 is a facing surface facing a side surface 12 of the center electrode 10, and the spark gap G is formed between the first tip surface 421 and the side surface 12 of the center electrode 10. The second tip surface 422 of the noble metal tip 42 is the other one of the two flat surfaces of the rectangular parallelepiped-shaped noble metal tip 42, which are not embedded in the ground electrode base member 41, among the six surfaces thereof. In the present embodiment, the second tip surface 422 is a flat surface parallel to the second base member surface 412 of the ground electrode base member 41; namely, a flat plane orthogonal to the center axis CA1 of the center electrode 10.

Figure 4:
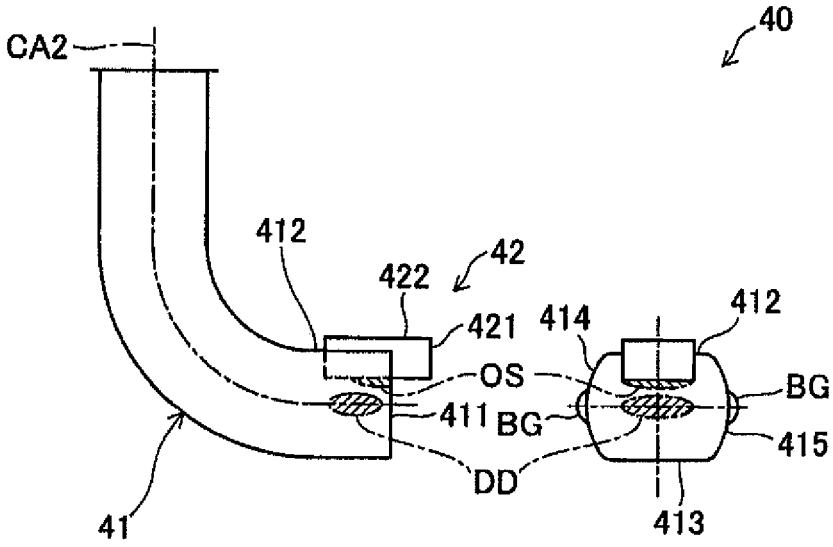
FIG. 4 is an explanatory view showing the oxide scale, dendrite, and bulge formed on the ground electrode.

FIG. 4 is an explanatory view showing oxide scale OS, dendrite DD, and bulges BG formed on the ground electrode 40. In FIG, 4, the oxide scale OS, the dendrite DD, and the bulges BG are schematically shown on the side and front views of the ground electrode 40. Over heating of the ground electrode 40 forms the oxide scale OS at a joint portion between the ground electrode base member 41 and the noble metal tip 42, which causes the separation of the noble metal tip 42 from the ground electrode base member 41. Excessively large current for resistance-welding the noble metal tip 42 to the ground electrode base member 41 forms the dendrite DD within the ground electrode base member 41, which lowers the strength of the ground electrode base member 41. The bulges BG are portions of the ground electrode base member 41 which bulge from the fourth base member surface 414 and the fifth base member surface 415 of the ground electrode base member 41 when the noble metal tip 42 is resistance-welded to the ground electrode base member 41. The bulges BG easily corrode, which causes deterioration of the ground electrode base member 41.

Referring back to FIG. 3, from the viewpoint of suppressing the dendrite DD and the oxide scale OS, the cross-sectional area S of a cross section of the ground electrode base member 41 orthogonal to the center axis (CA2) thereof is set to satisfy a relation "$1.8\ mm^2 \leq S \leq 3.2\ mm^2$." In such a case, the embedment depth A, which is the depth by which the noble metal tip 42 is embedded in the second base member surface 412 of the ground electrode base member 41, and the tip thickness B, which is the thickness of the noble metal tip 42 as measured along a direction in which the noble metal tip 42 is embedded in the second base member surface 412, preferably satisfy a relation "$0.4 \leq (A/B) \leq 0.8$," more preferably satisfy a relation "$0.6 \leq (A/B) \leq 0.8$," further more preferably satisfy a relation "$0.7 \leq (A/B) \leq 0.8$," most preferably satisfy a relation "$(A/B)=0.8$." Notably, the cross-sectional area S of the ground electrode base member 41 is one at a position 2 mm shifted from the first base member surface 411 along the center axis CA2. The evaluation value regarding the ratio (A/B) of the embedment depth A to the tip thickness B will be described later.

From the viewpoint of increasing the joint strength between the ground electrode base member 41 and the noble metal tip 42, the length (amount) C by which the noble metal tip 42 is embedded in the first base member surface 411 of the ground electrode base member 41 and the tip length D, which is the length of the noble metal tip 42 as measured along the direction in which the noble metal tip 42 is embedded in the first base member surface 411, preferably satisfy a relation "$0.6 \leq (C/D) < 1.0$." Notably, from the viewpoint of ignition performance, the tip length D of the noble metal tip 42 preferably satisfies a relation "$1.1\ mm \leq D \leq 1.3\ mm$." The evaluation value regarding the ratio (C/D) of the length C to the tip length D will be described later.

From the viewpoint of preventing deterioration of the ground electrode base member 41, the tip width E, which is the width of the noble metal tip 42 as measured along a direction which is orthogonal to the center axis CA1 of the center electrode 10 and is parallel to the first base member surface 411 of the ground electrode base member 41, and the flat surface width F, which is the width of the second base member surface 412 as measured along a direction parallel to the first base member surface 411, preferably satisfy a relation $(E/F) \leq 0.5$. The evaluation value regarding the ratio (E/F) of the tip width E to the flat surface width F will be described later.

Figure 5:
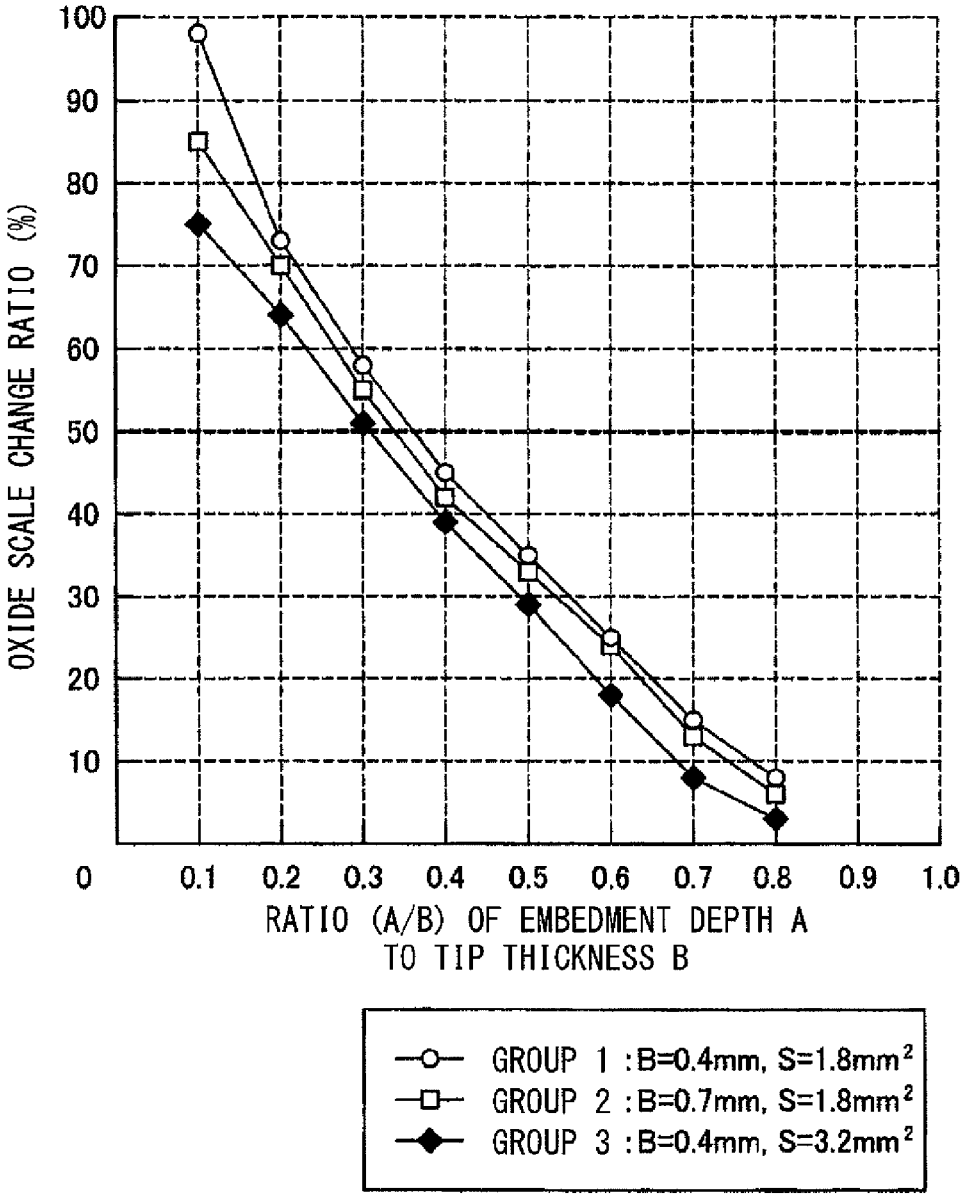
FIG. 5 is an explanatory chart showing the results of an evaluation test performed for investigating the relation between oxide scale and a ratio (A/B) of embedment depth A to tip thickness B.

A-2. Evaluation Value Regarding the Ratio (A/B) of the Embedment Depth A to the Tip Thickness B:

FIG. 5 is an explanatory chart showing the results of an evaluation test performed for investigating the relation between oxide scale and the ratio (A/B) of the embedment depth A to the tip thickness B. In the evaluation test of FIG. 5, a plurality of samples differing from one another in the embedment depth A of the noble metal tip 42 embedded in the ground electrode base member 41 were manufactured. After these samples were heated, the ground electrode 40 of each sample was cut, and the shape of the oxide scale OS was checked. Specifically, after performance of 1,000 heat cycles each including a heating period during which each sample was heated by a burner at 1,000° C. for 2 min under the condition of normal temperature and normal humidity and a subsequent cooling period during which the sample was cooled at normal temperature for one min, the sample was cut, and an oxide scale change ratio, which is the percentage of a portion of the joint portion between the ground electrode base member 41 and the noble metal tip 42, which portion changed to the oxide scale OS, was calculated. In FIG. 5, the relation between the ratio (A/B) and the oxide scale change ratio are shown, wherein the horizontal axis represents the ratio (A/B) of the embedment depth A to the tip thickness B, and the vertical axis represents the oxide scale change ratio.

Of the samples used in the evaluation test of FIG. 5, the samples of Group 1 are spark plugs in which a noble metal tip 42 having a tip thickness B of 0.4 mm is resistance welded to a ground electrode base member 41 having a cross sectional area S of $1.8\ mm^2$; the samples of Group 2 are spark plugs in which a noble metal tip 42 having a tip thickness B of 0.7 mm is resistance welded to a ground electrode base member 41 having a cross sectional area S of $1.8\ mm^2$; and the samples of Group 3 are spark plugs in which a noble metal tip 42 having a tip thickness B of 0.4 mm is resistance welded to a ground electrode base member 41 having a cross sectional area S of $3.2\ mm^2$. The conditions of resistance welding used for these samples are such that the power supply is AC, the current is 0.5 kA (kilo ampere), and the load is 50 N (newton). In the samples used for the evaluation test of FIG. 5, the tip length D of the noble metal tip 42 is 1.2 mm±0.1 mm, the tip width E of the noble metal tip 42 is 0.8 mm, and the projection amount (D-C) of the noble metal tip 42 in the direction of the tip length D is 0.4 mm.

When the samples used for the evaluation test of FIG. 5 were manufactured, the generation of the dendrite DD in the ground electrode base member 41 was not found under the condition "$(A/B) \leq 0.8$." In contrast, the generation of the dendrite DD was found at a rate of 40% to 60% under the condition "$(A/B)=0.9$." Accordingly, it was found that the generation of the dendrite DD is restrained under the condition "$(A/B) \leq 0.8$." The samples in which the generation of the dendrite DD was not found and which satisfied the condition "$(A/B) \leq 0.8$." were used in the evaluation test of FIG. 5.

As shown in FIG. 5, it was found that, under the condition "$(A/B) \leq 0.3$," all the samples of Groups 1 to 3 exhibit an oxide scale change ratio of 50% or greater, and have a considerably decreased joint strength between the ground electrode base member 41 and the noble metal tip 42. In contrast, it was found that, under the condition "$(A/B) \geq 0.4$," all the samples of Groups 1 to 3 exhibit an oxide scale change ratio of 50% or less. Specifically, the oxide scale change ratios of these samples decrease as the ratio (A/B) increases, and become 10% or less when the ratio (A/B) is 0.8.

Figure 6:
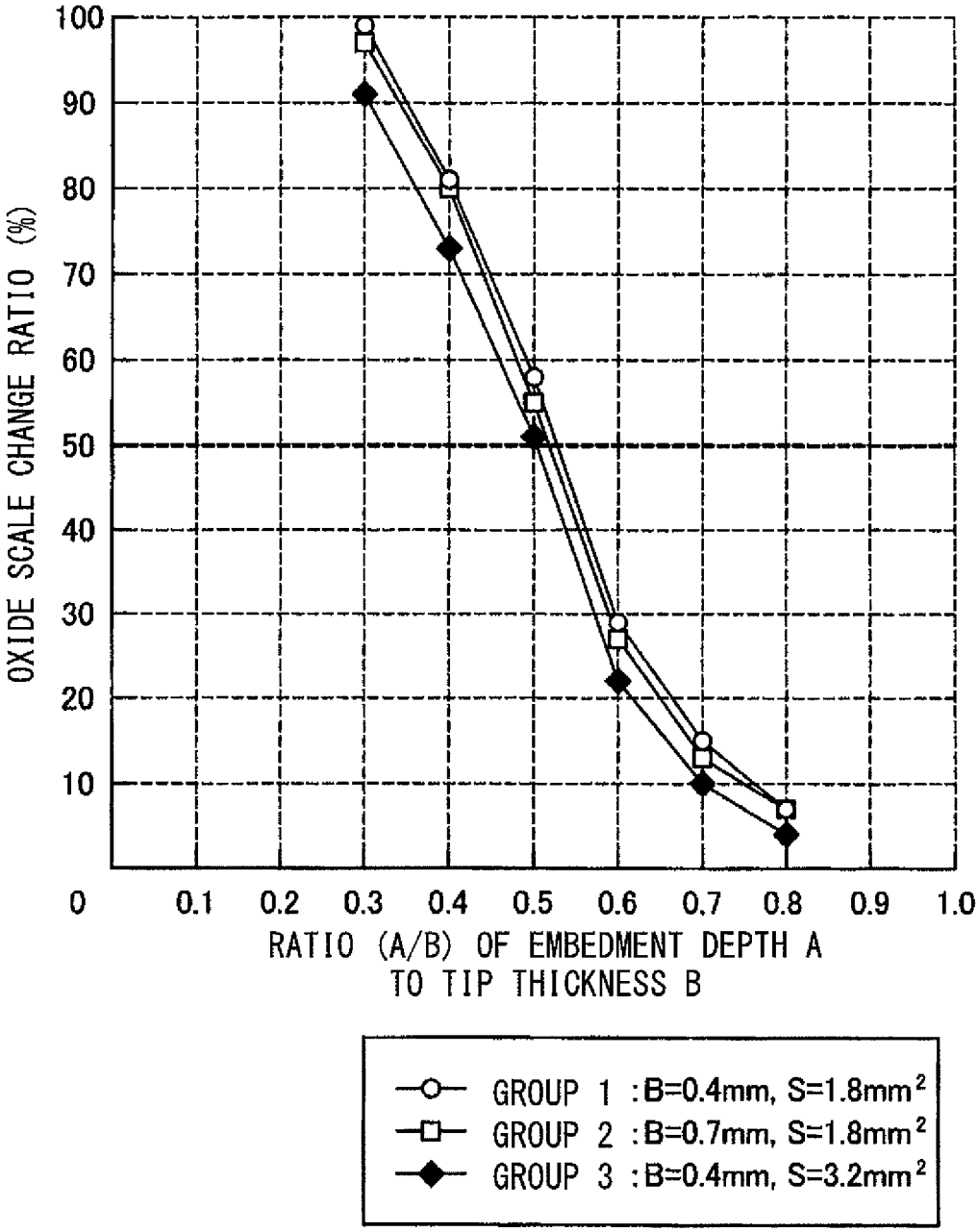
FIG. 6 is an explanatory chart showing the results of an evaluation test performed for investigating the relation between oxide scale change ratio and the ratio (A/B) of embedment depth A to tip thickness B.

FIG. 6 is an explanatory chart showing the results of an evaluation test performed for investigating the relation between the oxide scale change ratio and the ratio (A/B) of the embedment depth A to the tip thickness B. The evaluation test of FIG. 6 is identical with the evaluation test of FIG, 5 except that the samples are heated to a higher temperature that the heating temperature in the evaluation test of FIG. 5. Specifically, in the evaluation test of FIG. 6, the samples were subjected to 1,000 heat cycles each including a heating period during which each sample was heated by a burner at 1,100° C.

for 2 min under the condition of normal temperature and normal humidity and a subsequent cooling period during which the sample was cooled at normal temperature for one min. In FIG. 6, the relation between the ratio (A/B) and the oxide scale change ratio are shown, wherein the horizontal axis represents the ratio (A/B) of the embedment depth A to the tip thickness B, and the vertical axis represents the oxide scale change ratio. The samples used in the evaluation test of FIG. 6 are identical with those used in the evaluation test of FIG. 5.

As shown in FIG. 6, it was found that, under the condition "(A/B)≤0.5," all the samples of Groups 1 to 3 exhibit an oxide scale change ratio of 50% or greater, and have a considerably decreased joint strength between the ground electrode base member 41 and the noble metal tip 42. In contrast, it was found that, under the condition "(A/B)≥0.6," all the samples of Groups 1 to 3 exhibit an oxide scale change ratio of 30% or less. Specifically, the oxide scale change ratios of these samples decrease as the ratio (A/B) increases, and become 20% or less when the ratio (A/B) is 0.7 and become 10% or less when the ratio (A/B) is 0.8.

The results of the above-described evaluation tests of FIGS. 5 and 6 demonstrate that, from the viewpoints of restraining the dendrite DD and the oxide scale OS, in the case where the cross sectional area S of the ground electrode base member 41 satisfies a relation "1.8 $mm^2 \leq S \leq 3.2$ $mm^2$," the ratio (A/B) preferably satisfies a relation "0.4≤(A/B)≤0.8," more preferably satisfies a relation "0.6≤(A/B)≤0.8," further more preferably satisfies a relation "0.7≤(A/B)≤0.8," most preferably satisfies a relation "(A/B)=0.8."

Figure 7:
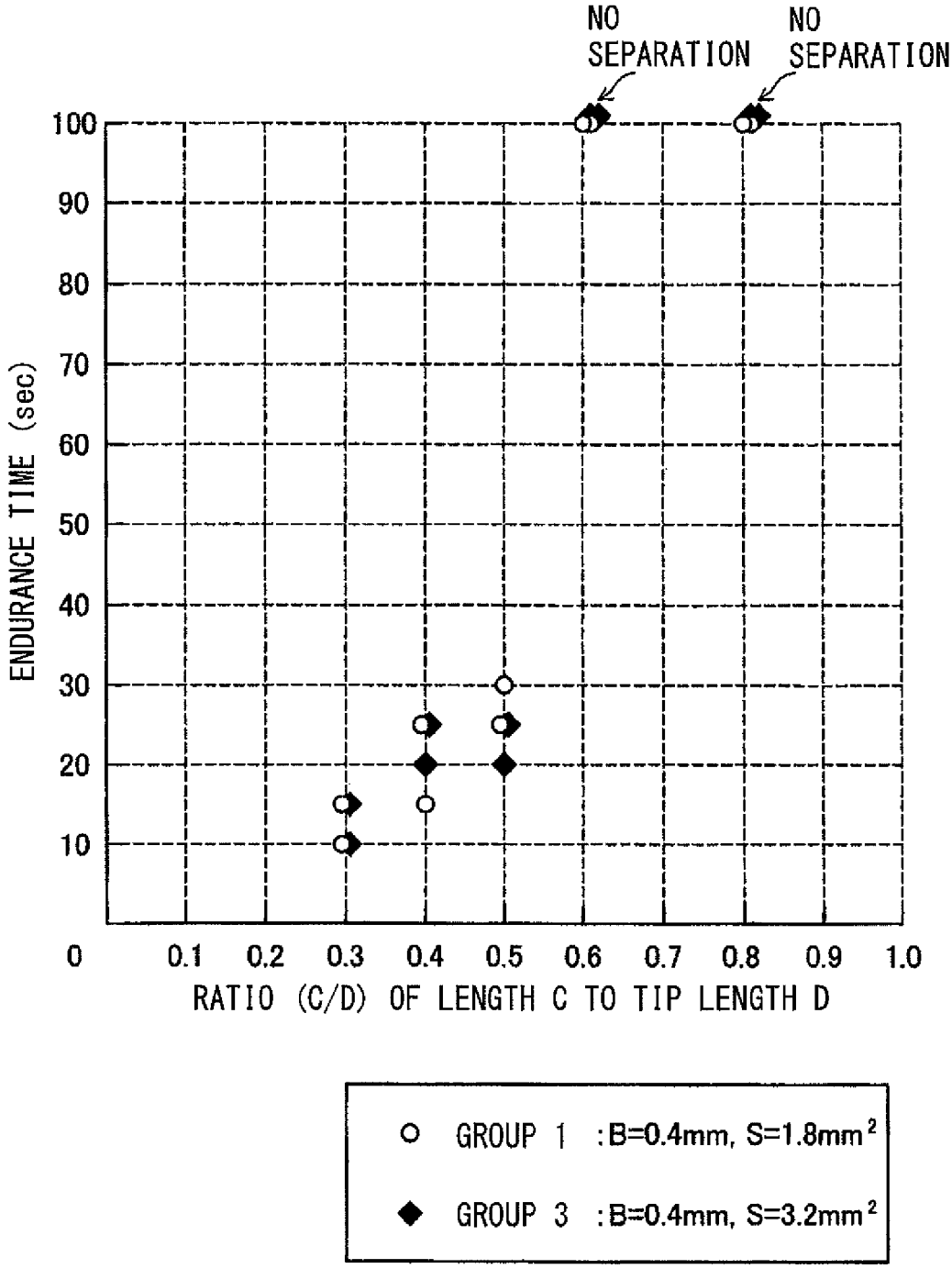
FIG. 7 is an explanatory chart showing the results of an evaluation test performed for investigating the relation between joint strength and a ratio (C/D) of length C to tip length D.

A-3. Evaluation Value Regarding the Ratio (C/D) of the Length C to the Tip Length D:

FIG. 7 is an explanatory chart showing the results of an evaluation test performed for investigating the relation between joint strength and the ratio (C/D) of the length C to the tip length D. In the evaluation test of FIG. 7, a plurality of samples differing from one another in the length C over which the noble metal tip 42 was embedded in the ground electrode base member 41 were manufactured. These samples were evaluated for the joint strength between the ground electrode base member 41 and the noble metal tip 42. Specifically, each sample was vibrated by an ultrasonic horn under the condition of normal temperature and normal humidity, and was measured for an endurance time (a time elapsed before the noble metal tip 42 separated from the ground electrode base member 41). In FIG. 7, the relation between the ratio (C/D) and the endurance time are shown, wherein the horizontal axis represents the ratio (C/D) of the length C to the tip length D, and the vertical axis represents the endurance time.

In the evaluation test of FIG. 7, a plurality of samples whose ratios (C/D) of the length C to the tip length D were "0.3," "0.4," "0.5," "0.6," and "0.8" were used. Of the samples used in the evaluation test of FIG. 7, the samples of Group 1 are spark plugs in which a noble metal tip 42 having a tip thickness B of 0.4 mm is resistance welded to a ground electrode base member 41 having a cross sectional area S of 1.8 $mm^2$; and the samples of Group 3 are spark plugs in which a noble metal tip 42 having a tip thickness B of 0.4 mm is resistance welded to a ground electrode base member 41 having a cross sectional area S of 3.2 $mm^2$. The conditions of resistance welding used for these samples are such that the power supply is AC, the current is 0.5 kA, and the load is 50 N. In the samples used for the evaluation test of FIG. 7, the tip length D of the noble metal tip 42 is 1.2 mm±0.1 mm, the tip width E of the noble metal tip 42 is 0.8 mm, and the ratio (A/B) of the embedment depth A to the tip thickness B is 0.5.

As shown in FIG. 7, under the condition of "(C/D)≤0.5," all the samples of Groups 1 and 3 suffered separation of the noble metal tip 42 from the ground electrode base member 41 upon elapse of an endurance time of 30 sec or less, even through the endurance time increased with the ratio (C/D). In contrast, under the condition of "(C/D)≥0.6," separation of the noble metal tip 42 was not observed even after elapse of 100 sec.

The results of the above-described evaluation test of FIG. 7 demonstrate that, from the viewpoints of increasing the joint strength between the ground electrode base member 41 and the noble metal tip 42, the ratio (C/D) preferably satisfies the relation "0.6≤(C/D)<1.0."

Figure 8:
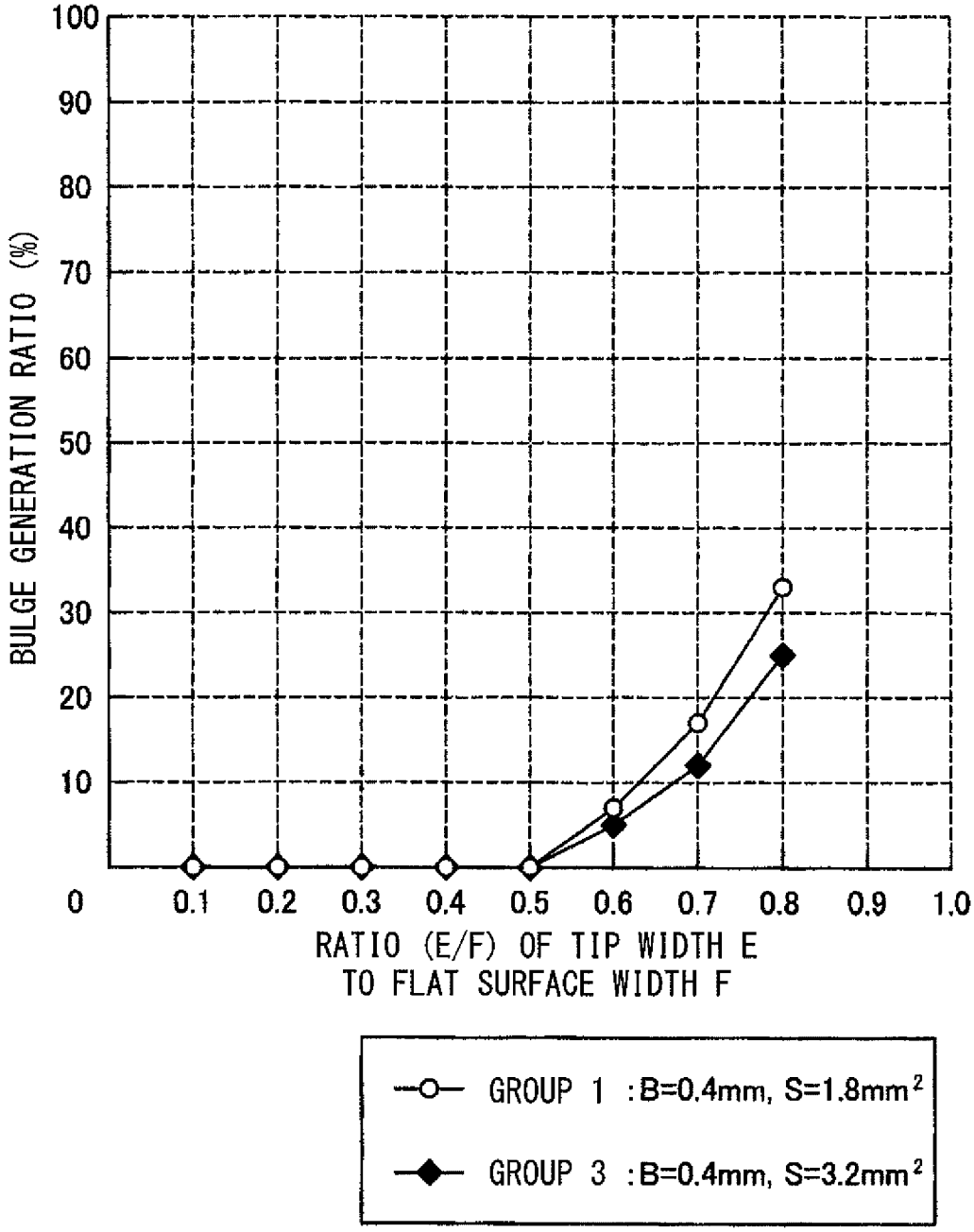
FIG. 8 is an explanatory chart showing the results of an evaluation test performed for investigating the relation between bulge generation ratio and a ratio (E/F) of tip width E to flat surface width F.

A-4. Evaluation Value Regarding the Ratio (E/F) of the Tip Width E to the Flat Surface Width F:

FIG. 8 is an explanatory chart showing the results of an evaluation test performed for investigating the relation between bulge generation ratio and the ratio (E/F) of the tip width E to the flat surface width F. In the evaluation test of FIG. 8, a plurality of samples differing from one another in the tip width E of the noble metal tip 42 were manufactured. These samples were visually checked so as to determine whether or not a bulge BG was generated on the fourth base member surface 414 and the fifth base member surface 415 of the ground electrode base member 41. For each value of the ratio (E/F), a bulge generation ratio at which the bulge BG was generated was calculated. In FIG. 8, the relation between the ratio (E/F) and the bulge generation ratio are shown, wherein the horizontal axis represents the ratio (E/F) of the tip width E to the flat surface width F, and the vertical axis represents the bulge generation ratio.

In the evaluation test of FIG. 8, a plurality of samples whose ratios (E/F) of the tip width E to the flat surface width F were "0.1," "0.2," "0.3," "0.4," "0.5," "0.6," "0.7," and "0.8" were manufactured. Of the samples used in the evaluation test of FIG. 8, the samples of Group 1 are spark plugs in which a noble metal tip 42 having a tip thickness B of 0.4 mm is resistance welded to a ground electrode base member 41 having a cross sectional area S of 1.8 $mm^2$; and the samples of Group 3 are spark plugs in which a noble metal tip 42 having a tip thickness B of 0.4 mm is resistance welded to a ground electrode base member 41 having a cross sectional area S of 3.2 $mm^2$. The conditions of resistance welding used for these samples are such that the power supply is AC, the current is 0.5 kA, and the load is 50 N. In the samples used for the evaluation test of FIG. 8, the tip length D of the noble metal tip 42 is 1.2 mm±0.1 mm, the ratio (A/B) of the embedment depth A to the tip thickness B is 0.5, and the projection amount (D-C) of the noble metal tip 42 in the direction of the tip length D is 0.4 mm.

As shown in FIG. 8, under the condition of "(E/F)≤0.5," generation of the bulge BG on the ground electrode base member 41 was not observed in any of the samples of Groups 1 and 3. In contrast, under the condition of "(E/F)≥0.6," generation of the bulge BG on the ground electrode base member 41 was observed, and it was found that the bulge generation ratio increases with the ratio (E/F).

The results of the above-described evaluation test of FIG. 8 demonstrate that, from the viewpoints of preventing deterioration of the ground electrode base member 41, the ratio (E/F) preferably satisfies the relation "(E/F)≤0.5."

A-5. Effects:

According the above-described spark plug 100, in the case where the cross sectional area S of the ground electrode base member 41 satisfies a relation "1.8 $mm^2 \leq S \leq 3.2$ $mm^2$," by determining the ratio (A/B) of the embedment depth A to the tip thickness B to satisfy a relation "0.4≤(A/B)≤0.8," it becomes possible to suppress formation of oxide scale OS at the joint portion between the ground electrode base member 41 and the noble metal tip 42, while suppressing formation of dendrite in the ground electrode base member 41 when the noble metal tip 42 is embedded in the ground electrode base member 41. As a result, the durability of the spark plug 100 can be enhanced.

Also, the formation of the oxide scale OS at the joint portion between the ground electrode base member 41 and the noble metal tip 42 can be restrained further by setting the ratio (A/B) to satisfy a relation "$0.6 \leq (A/B) \leq 0.8$." Also, the joint strength between the ground electrode base member 41 and the noble metal tip 42 can be increased by setting the ratio (C/D) of the length C to the tip length D such that the ratio (C/D) satisfies a relation "$0.6 \leq (C/D) < 1.0$." Also, generation of bulges BG which project from the ground electrode base member 41 as a result of resistance-welding of the noble metal tip 42 to the ground electrode base member 41 can be restrained by setting the ratio (E/F) of the tip width E to the flat surface width F such that the ratio (E/F) satisfies a relation "$(E/F) \leq 0.5$." As a result, deterioration of the ground electrode base member 41 caused by the bulges BG can be prevented.

Figure 9:
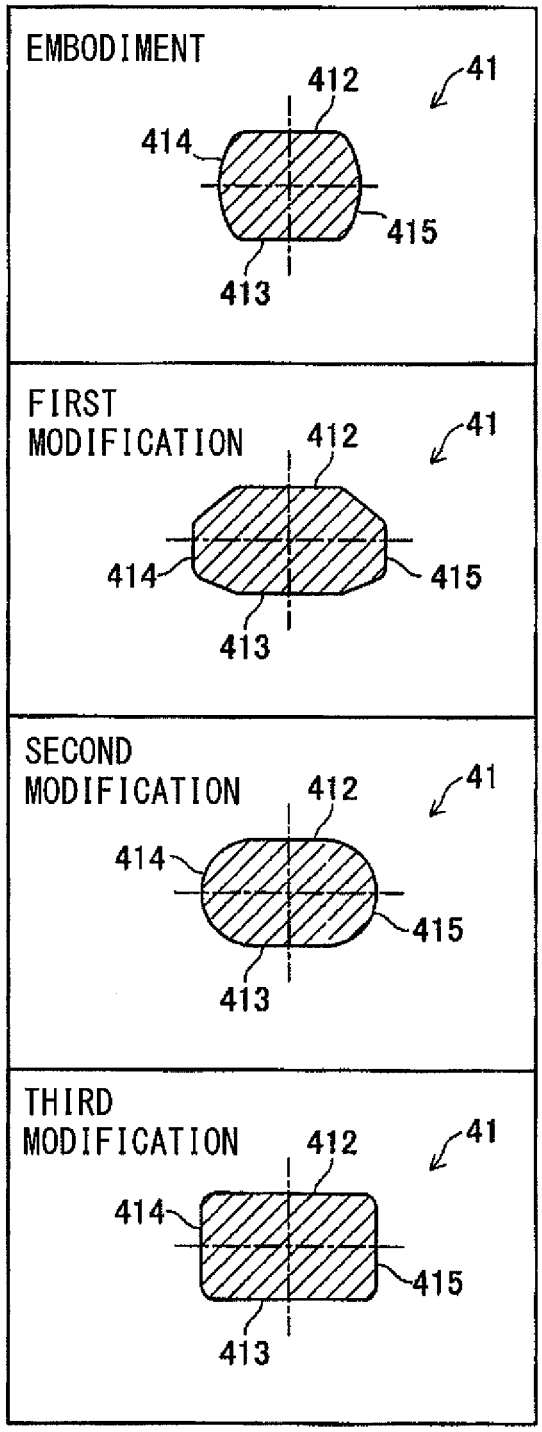
FIG. 9 is an explanatory view showing cross-sectional shapes of the ground electrode base member according to modifications.

B. Modifications:

FIG. 9 is an explanatory view showing the cross sectional shapes of the ground electrode base members 41 according to modifications. In FIG. 9, for comparison, the cross sectional shape of the ground electrode base member 41 used in the above-described embodiment is shown in the upper side, and the cross sectional shapes of ground electrode base members 41 according to first through third modifications are shown in the lower side in this sequence. The cross sectional shape of the ground electrode base member 41 is not limited to the shape employed in the above-described embodiment, and the ground electrode base member 41 may have any of the cross sectional shapes of the first through third modifications shown in FIG. 9. The cross sectional shape of the first modification is an approximately octagonal shape obtained by greatly chamfering the four corners of a rectangle. The cross sectional shape of the second modification is obtained by forming the fourth base member surface 414 and the fifth base member surface 415 in a semicircular shape. The cross sectional shape of the third modification is the shape of a rectangle with its four corners being rounded.

Figure 10:
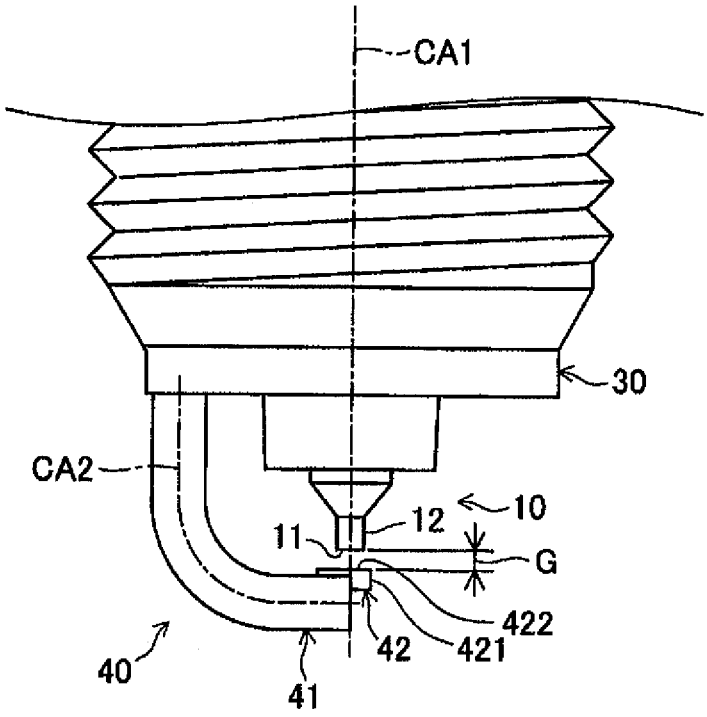
FIG. 10 is an explanatory view showing the ground electrode according to a modification.

FIG. 10 is an explanatory view showing a ground electrode 40 according to a modification. In the case of the ground electrode 40 of the above-described embodiment, the first tip surface 421 of the noble metal tip 42 serves as a facing surface which faces the side surface 12 of the center electrode 10. However, the embodiment may be modified such that, as shown in FIG. 10, the second tip surface 422 of the noble metal tip 42 serves as a facing surface which faces the end surface 11 of the center electrode 10. In the modification of FIG. 10, the spark gap G is formed between the ground electrode 40 and the end surface 11 of the center electrode 10.

C. Other Embodiments:

In the above, the embodiment of the present invention has been described. However, the present invention is not limited to the embodiment, and can be practiced in various forms without departing from the scope of the present invention.

Figure 11:
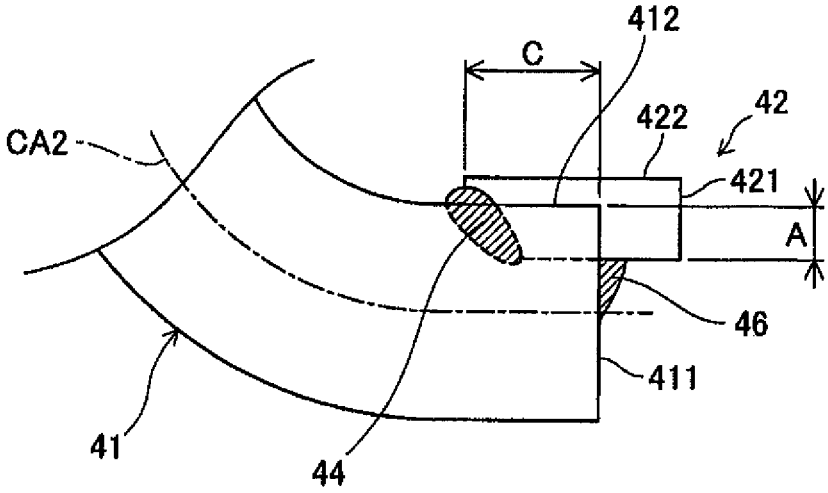
FIG. 11 is an explanatory view showing an example of the ground electrode.
Figure 12:
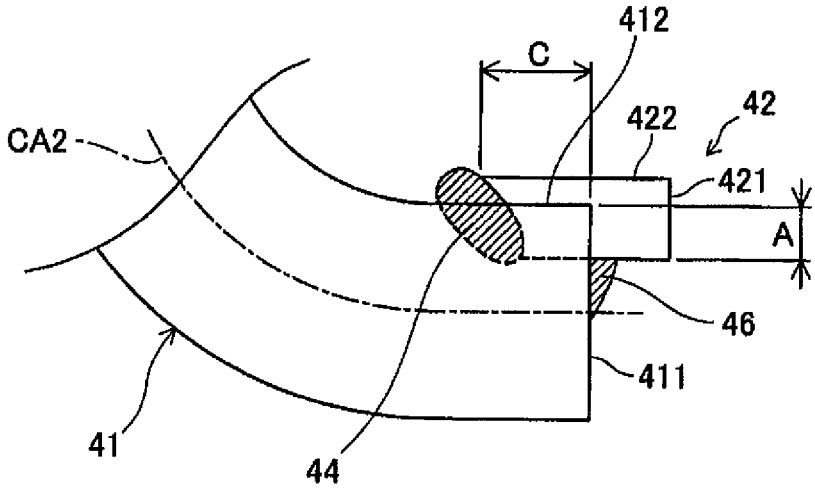
FIG. 12 is an explanatory view showing an example of the ground electrode.

FIGS. 11 and 12 are explanatory views showing examples of the ground electrode 40. Each of the ground electrodes 40 of FIGS. 11 and 12 has a fusion portion 44 and a swelling portion 46 formed when the ground electrode base member 41 and the noble metal tip 42 are resistance-welded together. The swelling portion 46 of the ground electrode 40 is a portion formed as a result of partial swelling of the first base member surface 411 of the ground electrode base member 41 at the time of resistance-welding between the ground electrode base member 41 and the noble metal tip 42, and covers a portion of the noble metal tip 42. The embedment depth A of the noble metal tip 42 described in the above-described embodiment is a length (amount) by which the noble metal tip 42 is embedded in the second base member surface 412 as measured on the first base member surface 411 of the ground electrode base member 41 as shown in FIGS. 11 and 12.

The fusion portion 44 of the ground electrode 40 is a portion formed as a result of swelling, from the second base member surface 412 of the ground electrode base member 41, of molten metal at the time of resistance-welding between the ground electrode base member 41 and the noble metal tip 42, and covers a portion of the noble metal tip 42. Although the second tip surface 422 of the noble metal tip 42 in FIG. 11 is not covered by the fusion portion 44, the second tip surface 422 of the noble metal tip 42 in FIG. 12 is partially covered by the fusion portion 44. The length C of the noble metal tip 42 described in the above-described embodiment is the length of the second tip surface 422 which extends in the embedment direction of the noble metal tip 42 from the first base member surface 411 of the ground electrode base member 41 as shown in FIGS. 11 and 12. In the case where the second tip surface 422 is not covered by the fusion portion 44 as shown in FIG. 11, the length C of the noble metal tip 42 is a length between the first base member surface 411 of the ground electrode base member 41 and the end portion of the second tip surface 422. In the case where a portion of the second tip surface 422 is covered by the fusion portion 44 as shown in FIG. 12, the length C of the noble metal tip 42 is a length between the first base member surface 411 of the ground electrode base member 41 and the boundary between the second tip surface 422 and the fusion portion 44.

DESCRIPTION OF REFERENCE NUMERALS AND SYMBOLS

10: center electrode
11: end surface
12: side surface
16: seal member
17: ceramic resistor
18: seal member
19: terminal metal piece
20: insulator
22: leg portion
24: first insulator trunk portion
25: insulator flange portion
26: second insulator trunk portion
28: axial hole
30: metallic shell
31: end surface
32: mount screw portion
34: trunk portion
35: groove portion
36: tool engagement portion
38: crimp portion
40: ground electrode
41: ground electrode base member
42: noble metal tip
44: fusion portion
46: swelling portion
50: gasket
62, 64: packing
63: talc charged portion
100: spark plug
200: engine head
210: mount screw hole

411: first base member surface
412: second base member surface
413: third base member surface
414: fourth base member surface
415: fifth base member surface
421: first tip surface
422: second tip surface
S: cross sectional area
A: embedment depth
B: tip thickness
C: length
D: tip length
E: tip width
F: flat surface width
G: spark gap
CA1: center axis
CA2: center axis
DD: dendrite
OS: oxide scale
BG: bulge Having described the invention, the following is claimed:

1. A spark plug comprising:

a rod-like center electrode extending along an axis;

an insulator provided around the center electrode;

a metallic shell provided around the insulator; and a ground electrode which is joined to the metallic shell and which forms a gap in cooperation with the center electrode, the ground electrode including a ground electrode base member and a rectangular parallelepiped-shaped noble metal tip, the ground electrode base member extending from the metallic shell toward the center electrode and having a first base member surface which is an end surface on the side toward the center electrode and a second base member surface adjacent to the first base member surface, the noble metal tip being embedded in the ground electrode base member, through resistance welding, such that the noble metal tip projects from the first base member surface and the second base member surface and having a facing surface which faces the center electrode, wherein a cross section of the ground electrode base member orthogonal to a center axis of the ground electrode base member has a cross-sectional area S which satisfies a relation $1.8\ mm^2 \leq S \leq 3.2\ mm^2$, and an embedment depth A and a tip thickness B satisfy a relation $0.4 \leq (A/B) \leq 0.8$, where the embedment depth A is a depth by which the noble metal tip is embedded in the second base member surface, and the tip thickness B is a thickness of the noble metal tip as measured along a direction in which the noble metal tip is embedded in the second base member surface.

2. A spark plug according to claim 1, wherein a relation $0.6 \leq (A/B) \leq 0.8$ is satisfied.

3. A spark plug according to claim 1, wherein an embedment depth C and a tip length D satisfy a relation $0.6 \leq (C/D) < 1.0$, where the embedment depth C is a depth by which the noble metal tip is embedded in the first base member surface, and the tip length D is a length of the noble metal tip as measured along the direction in which the noble metal tip is embedded in the first base member surface.

4. A spark plug according to claim 1, wherein the second base member surface is a flat surface orthogonal to the axis, and a tip width E and a flat surface width F satisfy a relation $(E/F) \leq 0.5$, where the tip width E is a width of the noble metal tip as measured along a direction which is orthogonal to the axis and is parallel to the first base member surface, and the flat surface width F is a width of the second base member surface as measured along a direction parallel to the first base member surface.

5. A spark plug according to claim 1, wherein the facing surface faces an end surface or a side surface of the center electrode.

6. A spark plug according to claim 1, wherein the tip length D, which is the length of the noble metal tip as measured along the direction in which the noble metal tip is embedded in the first base member surface, satisfies a relation $1.1\ mm \leq D \leq 1.3\ mm$.

* * * * *